US008833029B2

(12) United States Patent
Grafenauer

(10) Patent No.: US 8,833,029 B2
(45) Date of Patent: Sep. 16, 2014

(54) FLOOR PANEL

(75) Inventor: Thomas Grafenauer, Onzour sur Loire (FR)

(73) Assignee: Kronotec AG, Luzern (CH)

( * ) Notice: Subject to any disclaimer, the term of this patent is extended or adjusted under 35 U.S.C. 154(b) by 919 days.

(21) Appl. No.: 12/576,007

(22) Filed: Oct. 8, 2009

(65) Prior Publication Data

US 2010/0088993 A1 Apr. 15, 2010

Related U.S. Application Data

(63) Continuation of application No. 10/697,567, filed on Oct. 31, 2003, now Pat. No. 7,617,651.

(30) Foreign Application Priority Data

Nov. 12, 2002 (DE) ..... 102 52 864

(51) Int. Cl.
*E04F 15/02* (2006.01)

(52) U.S. Cl.
CPC ..... *E04F 15/02* (2013.01); *E04F 2201/0153* (2013.01); *E04F 2201/023* (2013.01); *E04F 2201/05* (2013.01); *E04F 2201/026* (2013.01)
USPC ..... 52/592.1

(58) Field of Classification Search
USPC ..... 52/589.1, 586.1, 590.2, 590.3, 591.1, 52/591.3, 591.4, 592.1, 592.2, 592.3, 52/592.4
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |

(Continued)

FOREIGN PATENT DOCUMENTS

| | | |
|---|---|---|
| AT | 005566 | 8/2002 |
| AU | 713628 | 5/1998 |

(Continued)

OTHER PUBLICATIONS

U.S. Court of Appeals for the Federal Circuit, 02-1222-1291 *Alloc, Inc.* vs. *International Trade Commission*, pp. 1-32, 2003.

(Continued)

*Primary Examiner* — Joshua J Michener
(74) *Attorney, Agent, or Firm* — Andrew M. Calderon; Roberts Mlotkowski Safran & Cole, P.C.

(57) ABSTRACT

A floor panel is bounded in a horizontal plane by a top side, which is provided with a decorative layer, and an underside, which is provided for bearing on an underlying surface. The floor panel is provided with connecting structure for the releasable connection of at least two panels. The connecting structure is formed on at least one first side edge such that locking takes place in the transverse direction and vertical direction. A form-fitting element for locking in the vertical direction with a further panel is formed on a second side edge, which runs at an angle to the first side edge. A tongue is formed on the first side edge, the tongue extending in the longitudinal direction of the side edge, and a recess, corresponding to the tongue, is formed on an opposite side edge.

19 Claims, 3 Drawing Sheets

(56) References Cited

U.S. PATENT DOCUMENTS

| | | | |
|---|---|---|---|
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,637,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,535,844 | A | 10/1970 | Glaros |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,090,338 | A | 5/1978 | Bourgade |
| 4,091,136 | A | 5/1978 | O'Brien et al. |
| 4,099,358 | A | 7/1978 | Compaan |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,501,102 | A | 2/1985 | Knowles |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 4,947,602 | A | 8/1990 | Pollasky |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,165,816 | A | 11/1992 | Parasin |
| 5,179,812 | A | 1/1993 | Hill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,630,304 | A | 5/1997 | Austin |
| 5,653,099 | A | 8/1997 | MacKenzie |
| 5,671,575 | A | 9/1997 | Wu |
| 5,694,734 | A | 12/1997 | Cercone et al. |
| 5,706,621 | A | 1/1998 | Pervan |
| 5,736,227 | A | 4/1998 | Sweet et al. |
| 5,768,850 | A | 6/1998 | Chen |
| 5,797,237 | A * | 8/1998 | Finkell, Jr. ..... 52/589.1 |
| 5,823,240 | A | 10/1998 | Bolyard et al. |
| 5,827,592 | A | 10/1998 | Van Gulik et al. |
| 5,860,267 | A | 1/1999 | Pervan |
| 5,935,668 | A | 8/1999 | Smith |
| 5,943,239 | A | 8/1999 | Shamblin et al. |
| 5,953,878 | A | 9/1999 | Johnson |
| 5,968,625 | A | 10/1999 | Hudson |
| 5,985,397 | A | 11/1999 | Witt et al. |

(56) References Cited

U.S. PATENT DOCUMENTS

| | | | | |
|---|---|---|---|---|
| 5,987,839 | A | 11/1999 | Hamar et al. | |
| 6,006,486 | A | 12/1999 | Moriau et al. | |
| 6,023,907 | A | 2/2000 | Pervan | |
| 6,094,882 | A | 8/2000 | Pervan | |
| 6,101,778 | A | 8/2000 | Martensson | |
| 6,119,423 | A | 9/2000 | Costantino | |
| 6,134,854 | A | 10/2000 | Stanchfield | |
| 6,148,884 | A | 11/2000 | Bolyard et al. | |
| 6,168,866 | B1 | 1/2001 | Clark | |
| 6,182,410 | B1 | 2/2001 | Pervan | |
| 6,186,703 | B1 | 2/2001 | Shaw | |
| 6,205,639 | B1 | 3/2001 | Pervan | |
| 6,209,278 | B1 | 4/2001 | Tychsen | |
| 6,216,403 | B1 | 4/2001 | Belbeoc'h | |
| 6,216,409 | B1 | 4/2001 | Roy et al. | |
| D442,296 | S | 5/2001 | Külik | |
| D442,297 | S | 5/2001 | Külik | |
| D442,298 | S | 5/2001 | Külik | |
| D442,706 | S | 5/2001 | Külik | |
| D442,707 | S | 5/2001 | Külik | |
| 6,224,698 | B1 | 5/2001 | Endo | |
| 6,238,798 | B1 | 5/2001 | Kang et al. | |
| 6,247,285 | B1 | 6/2001 | Moebus | |
| D449,119 | S | 10/2001 | Külik | |
| D449,391 | S | 10/2001 | Külik | |
| D449,392 | S | 10/2001 | Külik | |
| 6,324,803 | B1 | 12/2001 | Pervan | |
| 6,345,481 | B1 | 2/2002 | Nelson | |
| 6,363,677 | B1 | 4/2002 | Chen et al. | |
| 6,397,547 | B1 | 6/2002 | Martensson | |
| 6,418,683 | B1 | 7/2002 | Martensson et al. | |
| 6,421,970 | B1 | 7/2002 | Martensson et al. | |
| 6,436,159 | B1 | 8/2002 | Safta et al. | |
| 6,446,405 | B1 | 9/2002 | Pervan | |
| 6,449,913 | B1 | 9/2002 | Shelton | |
| 6,458,232 | B1 | 10/2002 | Valentinsson | |
| 6,461,636 | B1 | 10/2002 | Arth et al. | |
| 6,465,046 | B1 | 10/2002 | Hansson et al. | |
| 6,490,836 | B1 | 12/2002 | Moriau et al. | |
| 6,497,961 | B2 | 12/2002 | Kang et al. | |
| 6,505,452 | B1 | 1/2003 | Hanning et al. | |
| 6,510,665 | B2 | 1/2003 | Pervan | |
| 6,516,579 | B1 | 2/2003 | Pervan | |
| 6,517,935 | B1 | 2/2003 | Kornfalt et al. | |
| 6,519,912 | B1 | 2/2003 | Eckmann et al. | |
| 6,521,314 | B2 | 2/2003 | Tychsen | |
| 6,532,709 | B2 | 3/2003 | Pervan | |
| 6,533,855 | B1 | 3/2003 | Gaynor et al. | |
| 6,536,178 | B1 | 3/2003 | Pålsson et al. | |
| 6,546,691 | B2 | 4/2003 | Peopolder | |
| 6,558,754 | B1 | 5/2003 | Velin et al. | |
| 6,565,919 | B1 | 5/2003 | Hansson et al. | |
| 6,569,272 | B2 | 5/2003 | Tychsen | |
| 6,584,747 | B2 * | 7/2003 | Kettler et al. | 52/592.2 |
| 6,588,166 | B2 * | 7/2003 | Martensson et al. | 52/578 |
| 6,591,568 | B1 * | 7/2003 | Palsson | 52/592.2 |
| 6,601,359 | B2 | 8/2003 | Olofsson | |
| 6,606,834 | B2 | 8/2003 | Martensson et al. | |
| 6,635,174 | B1 | 10/2003 | Berg et al. | |
| 6,641,629 | B2 | 11/2003 | Safta et al. | |
| 6,646,088 | B2 | 11/2003 | Fan et al. | |
| 6,647,690 | B1 | 11/2003 | Martensson | |
| 6,649,687 | B1 | 11/2003 | Gheewala et al. | |
| 6,659,097 | B1 | 12/2003 | Houston | |
| 6,672,030 | B2 | 1/2004 | Schulte | |
| 6,681,820 | B2 | 1/2004 | Olofsson | |
| 6,682,254 | B1 | 1/2004 | Olofsson et al. | |
| 6,685,993 | B1 | 2/2004 | Hansson et al. | |
| 6,711,869 | B2 | 3/2004 | Tychsen | |
| 6,715,253 | B2 | 4/2004 | Pervan | |
| 6,723,438 | B2 | 4/2004 | Chang et al. | |
| 6,729,091 | B1 | 5/2004 | Martensson | |
| 6,745,534 | B2 | 6/2004 | Kornfalt | |
| 6,761,794 | B2 | 7/2004 | Mott et al. | |
| 6,763,643 | B1 * | 7/2004 | Martensson | 52/586.1 |
| 6,766,622 | B1 | 7/2004 | Thiers | |
| 6,769,218 | B2 | 8/2004 | Pervan | |
| 6,772,568 | B2 * | 8/2004 | Thiers et al. | 52/592.1 |
| 6,786,019 | B2 | 9/2004 | Thiers | |
| 6,803,109 | B2 | 10/2004 | Qiu et al. | |
| 6,804,926 | B1 | 10/2004 | Eisermann | |
| 6,805,951 | B2 | 10/2004 | Kornfält et al. | |
| 6,823,638 | B2 | 11/2004 | Stanchfield | |
| 6,841,023 | B2 | 1/2005 | Mott | |
| 2001/0029720 | A1 | 10/2001 | Pervan | |
| 2001/0034992 | A1 | 11/2001 | Pletzer et al. | |
| 2002/0007608 | A1 | 1/2002 | Pervan | |
| 2002/0007609 | A1 | 1/2002 | Pervan | |
| 2002/0014047 | A1 | 2/2002 | Thiers | |
| 2002/0020127 | A1 | 2/2002 | Thiers et al. | |
| 2002/0046528 | A1 | 4/2002 | Pervan et al. | |
| 2002/0056245 | A1 | 5/2002 | Thiers | |
| 2002/0106439 | A1 | 8/2002 | Cappelle | |
| 2002/0112429 | A1 | 8/2002 | Niese et al. | |
| 2002/0160680 | A1 | 10/2002 | Laurence et al. | |
| 2002/0170258 | A1 | 11/2002 | Schwitte et al. | |
| 2002/0178681 | A1 | 12/2002 | Zancai et al. | |
| 2002/0178682 | A1 | 12/2002 | Pervan | |
| 2003/0024200 | A1 | 2/2003 | Moriau et al. | |
| 2003/0024201 | A1 | 2/2003 | Moriau et al. | |
| 2003/0029115 | A1 | 2/2003 | Moriau et al. | |
| 2003/0029116 | A1 | 2/2003 | Moriau et al. | |
| 2003/0029117 | A1 | 2/2003 | Moriau et al. | |
| 2003/0033777 | A1 | 2/2003 | Thiers et al. | |
| 2003/0033784 | A1 | 2/2003 | Pervan | |
| 2003/0037504 | A1 | 2/2003 | Schwitte et al. | |
| 2003/0066588 | A1 | 4/2003 | Palsson et al. | |
| 2003/0079820 | A1 * | 5/2003 | Palsson et al. | 156/91 |
| 2003/0093964 | A1 | 5/2003 | Bushey et al. | |
| 2003/0094230 | A1 | 5/2003 | Sjoberg | |
| 2003/0101681 | A1 | 6/2003 | Tychsen | |
| 2003/0115812 | A1 | 6/2003 | Pervan | |
| 2003/0115821 | A1 | 6/2003 | Pervan | |
| 2003/0159385 | A1 | 8/2003 | Thiers | |
| 2003/0167717 | A1 | 9/2003 | Garcia | |
| 2003/0196405 | A1 | 10/2003 | Pervan | |
| 2003/0205013 | A1 | 11/2003 | Garcia | |
| 2003/0233809 | A1 | 12/2003 | Pervan | |
| 2004/0016196 | A1 | 1/2004 | Pervan | |
| 2004/0035078 | A1 | 2/2004 | Pervan | |
| 2004/0068954 | A1 | 4/2004 | Martensson | |
| 2004/0092006 | A1 | 5/2004 | Lindekens et al. | |
| 2004/0105994 | A1 | 6/2004 | Lu et al. | |
| 2004/0139678 | A1 | 7/2004 | Pervan | |
| 2004/0159066 | A1 | 8/2004 | Thiers et al. | |
| 2004/0177584 | A1 | 9/2004 | Pervan | |
| 2004/0200165 | A1 | 10/2004 | Garcia et al. | |
| 2004/0206036 | A1 | 10/2004 | Pervan | |
| 2004/0237447 | A1 | 12/2004 | Thiers et al. | |
| 2004/0237448 | A1 | 12/2004 | Thiers et al. | |
| 2004/0241374 | A1 | 12/2004 | Thiers et al. | |
| 2004/0244322 | A1 | 12/2004 | Thiers et al. | |
| 2004/0250493 | A1 | 12/2004 | Thiers et al. | |
| 2004/0255541 | A1 | 12/2004 | Thiers et al. | |
| 2004/0258907 | A1 | 12/2004 | Kornfalt et al. | |
| 2005/0003149 | A1 | 1/2005 | Kornfalt et al. | |
| 2005/0005559 | A1 | 1/2005 | Ralf | |
| 2005/0016099 | A1 | 1/2005 | Thiers | |

FOREIGN PATENT DOCUMENTS

| | | |
|---|---|---|
| AU | 200020703 | 1/2000 |
| BE | 417526 | 9/1936 |
| BE | 557844 | 6/1957 |
| BE | 557844 | 3/1960 |
| BE | 09600527 | 6/1998 |
| BE | 09700344 | 10/1998 |
| CA | 991373 | 6/1976 |
| CA | 2226286 | 12/1987 |
| CA | 2252791 | 5/1999 |
| CA | 2289309 | 7/2000 |
| CH | 200949 | 1/1939 |
| CH | 211877 | 1/1941 |
| CH | 562377 | 5/1975 |

(56) References Cited

FOREIGN PATENT DOCUMENTS

| | | |
|---|---|---|
| DE | 314207 | 9/1919 |
| DE | 531989 | 8/1931 |
| DE | 740235 | 10/1943 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2252643 | 10/1972 |
| DE | 2238660 | 2/1974 |
| DE | 7402354 | 5/1974 |
| DE | 2616077 | 10/1977 |
| DE | 2917025 | 11/1980 |
| DE | 7911924 | 3/1981 |
| DE | 7928703 | 5/1981 |
| DE | 07928703 | 7/1981 |
| DE | 3041781 | 6/1982 |
| DE | 3214207 | 11/1982 |
| DE | 8226153 | 1/1983 |
| DE | 3343601 | 6/1985 |
| DE | 86040049 | 6/1986 |
| DE | 3512204 | 10/1986 |
| DE | 3246376 | 2/1987 |
| DE | 4004891 | 9/1990 |
| DE | 4002547 | 8/1991 |
| DE | 4134452 | 4/1993 |
| DE | 4242530 | 6/1994 |
| DE | 4011656 | 1/1995 |
| DE | 4324137 | 1/1995 |
| DE | 4107151 | 2/1995 |
| DE | 29517128 | 2/1996 |
| DE | 4242530 | 9/1996 |
| DE | 3544845 | 12/1996 |
| DE | 29710175 | 9/1997 |
| DE | 19616510 | 3/1998 |
| DE | 19651149 | 6/1998 |
| DE | 19709641 | 9/1998 |
| DE | 19718319 | 11/1998 |
| DE | 19735189 | 6/2000 |
| DE | 20001225 | 8/2000 |
| DE | 19925248 | 12/2000 |
| DE | 20017461 | 3/2001 |
| DE | 20018284 | 3/2001 |
| DE | 200 10 913 U1 | 4/2001 |
| DE | 20203311 | 6/2002 |
| DE | 20121196 | 7/2002 |
| DE | 20206460 | 8/2002 |
| DE | 102 24 540 A1 | 12/2003 |
| DE | 20218331 | 5/2004 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 0843763 | 10/2000 |
| EP | 12006690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 1019585 | 12/1991 |
| ES | 1019585 | 4/1992 |
| ES | 2168045 | 5/2002 |
| FI | 843060 | 8/1984 |
| FR | 1293043 | 4/1962 |
| FR | 2691491 | 11/1983 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-270193 | 10/1996 |
| NE | 7601773 | 2/1976 |
| NO | 157871 | 2/1988 |
| NO | 305614 | 6/1999 |
| RU | 363795 | 12/1972 |
| SE | 7114900-9 | 9/1974 |
| SE | 450141 | 6/1987 |
| SE | 450411 | 6/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 94126999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99140273 | 8/1999 |

(56) References Cited

FOREIGN PATENT DOCUMENTS

| | | |
|---|---|---|
| WO | 99/66151 | 12/1999 |
| WO | 9966152 | 12/1999 |
| WO | 0006854 | 2/2000 |
| WO | 0066856 | 11/2000 |
| WO | 01/02669 | 1/2001 |
| WO | 01/51732 | 7/2001 |
| WO | 0166876 | 9/2001 |
| WO | 01/75247 | 10/2001 |

OTHER PUBLICATIONS

U.S. Court of Appeals for the Federal Circuit Decision in *Alloc, Inc. et al.* vs. *International Trade Commission and Pergs, Inc. et al.* decided Sep. 10, 2003.

* cited by examiner

FLOOR PANEL

CROSS REFERENCE TO RELATED APPLICATIONS

This application is a continuation of U.S. application Ser. No. 10/697,567 filed on Oct. 31, 2003 now U.S. Pat. No. 7,617,651, which claims priority under 35 U.S.C. §119 to German Application No. 102 52 864 filed on Nov. 12, 2002, the contents of all of which are incorporated herein by reference in their entirety.

BACKGROUND OF THE INVENTION

1. Field of the Invention

The invention relates to a floor panel.

2. Background Description

WO 01/75247 A1 discloses a floor panel which, on a first side edge, has connecting means for locking in the transverse and vertical directions. These locking means are arranged on the longitudinal side of the panel and bring about locking by the connecting means being introduced and pivoted into a corresponding recess of a second panel. The transverse side of the panel has two snap-in hooks which, when the panels are laid, are intended to engage in corresponding undercuts of an adjacent panel and to hinder the vertical movement between the laid panels. The two snap-in hooks are located vertically one above the other.

The disadvantage with such a profile is the fact that such a profile configuration does not ensure that the panels are securely locked with one another since the snap-in hooks, which are arranged one above the other, are pressed in during the laying movement and, in the case of a resilient underlying surface, for example carpet, the transverse side springs out of the locking means when the panels are stepped on with force. This is also due to the fact that the panel provided with the snap-in hooks is angled slightly relative to the corresponding panel when stepped on, with the result that the panel twists out to some extent.

SUMMARY OF THE INVENTION

The object of the present invention is to provide a panel which allows straightforward laying and which ensures secure locking both in the transverse direction and in the vertical direction.

The object is achieved according to the invention by a floor panel having the features of claim 1. Advantageous configurations and developments of the invention are given in the dependent subclaims. By virtue of the rounded design of the underside of the tongue on the first side edge, it is particularly easy to pivot the panel into the corresponding groove of the already laid panel, the spacing apart of form-fitting elements in the transverse and vertical directions providing two spatially separate locking locations on the second side edge. This second side edge is advantageously arranged on the transverse side, and the spatially separated locking locations ensure that the panels, which have been positioned against one another and laid, are better secured.

A development of the invention provides that the radius of curvature of the contour of the underside of the tongue remains essentially constant over at least 90°, with the result that a uniform pivoting-in movement and a straightforward sliding action on the corresponding recess can take place.

A development provides that a step-like milled relief with a shoulder which projects in the direction of the underside is formed on the second side edge, the shoulder having an essentially horizontally oriented head surface in which is incorporated a channel which is oriented along the longitudinal extent of the second side edge. This channel creates a dust pocket in which dirt or abraded material which is produced during laying of the panels may be enclosed without this adversely affecting the laying accuracy. The channel, furthermore, gives rise to a slight spring effect, with the result that the locking on the second side edge is subjected to a certain amount of prestressing.

BRIEF DESCRIPTION OF THE DRAWINGS

An exemplary embodiment of the invention will be described hereinbelow with reference to the attached figures, in which the same designations are used to designate the same objects and in which.

DETAILED DESCRIPTION OF EMBODIMENTS OF THE INVENTION

Figure 1:
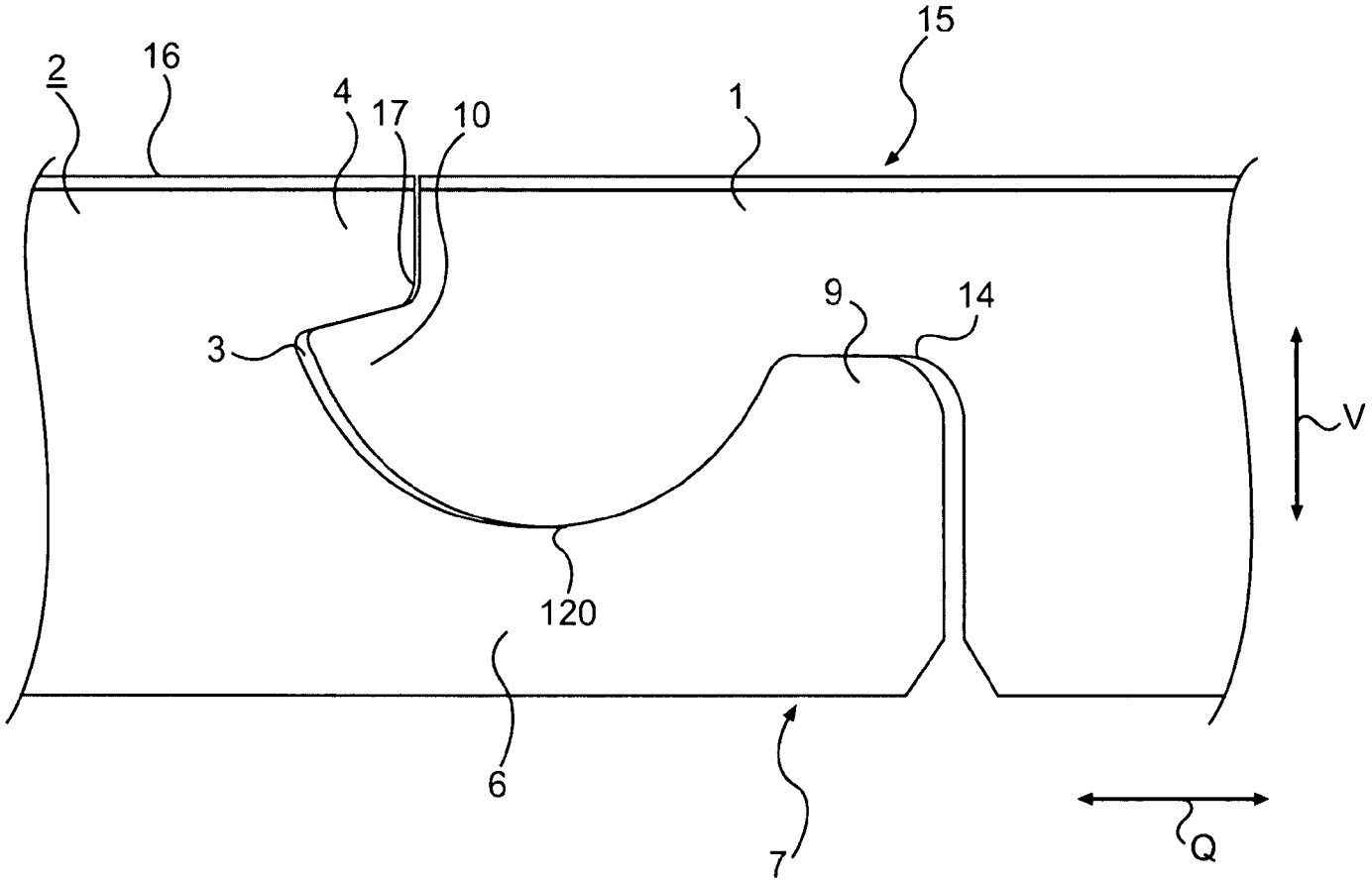
FIG. 1 shows a partial cross section of two interconnected panels at the connecting location.

FIG. 1 shows a floor panel 1 which comprises a medium-density or high-density fiberboard (MDF or HDF), which is locked with a second floor panel 2. On their top side 15, the floor panels 1, 2 are provided with a decorative layer 16 which may be formed, for example, by a paper layer which exhibits a woodgrain and is coated with a synthetic-resin layer serving to protect against wear. A sound-insulation layer may be adhesively bonded to the underside in order to improve the footfall-sound properties of the laid floor panels 1, 2. As an alternative to using an HDF or MDF board, the panel may be produced from an OSB material.

The panel 1 is provided with a tongue 10 on a first side edge, preferably on the longitudinal side of the panel, and with a correspondingly designed groove 3 on the opposite side. The groove 3 and the tongue 10 run over the entire length of the side edge. Provided on the tongue 10 is an outwardly projecting, rounded nose, which is adjoined by the underside 120 of the tongue 10 with a rounded contour. The radius of this contour is constant over at least 90 degrees and thus allows the tongue 10 to slide easily into the groove 3.

In the installed state, the tongue 10 engages in an undercut formed by the top lip 4 of the groove 3, with the result that locking takes place in the vertical direction V along the first edge. The locking in the transverse direction Q takes place by virtue of the underside 120 of the tongue 10 butting in a form-fitting manner against a shoulder 9, which terminates the groove 3. Formed on the top side of the shoulder 9 is a horizontally running surface which serves as a support for a bearing region 14.

The operations of laying and locking two panels 1, 2 with such a profile take place by virtue of the first panel 1 being positioned with the tongue 10 at an angle to the second panel 2 and by the tongue 10 being introduced into the groove 3 of the second panel 2. The angled first panel 1 is then pivoted about an axis parallel to the longitudinal direction of the first side edge, in the present case in the clockwise direction, with the result that the round contour of the underside 120 of the tongue 10 slides along in the groove 3 until the bearing region 14 rests in a planar manner on the shoulder 9. In this state, the undercut of the top lip 4 and also the shoulder 9 result in effective locking in the vertical direction V and transverse direction Q.

Figure 2:
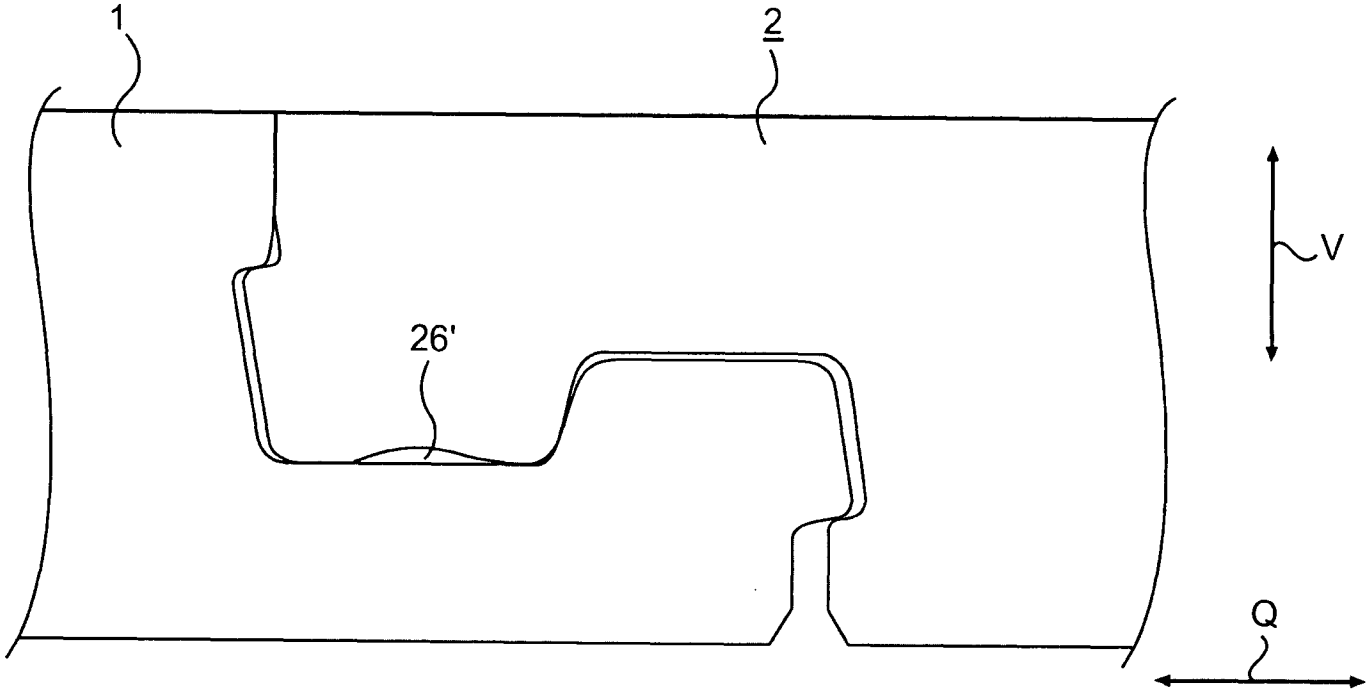
FIG. 2 shows a partial cross section of two interconnected panels at a second connecting location.

In order to allow locking with another panel not just on two opposite side edges of a panel, a profile which is illustrated in FIG. 2 is formed on a second edge, which runs preferably at right angles to the first edge. Here too, corresponding profiles are formed on opposite side edges, as can be gathered from FIG. 2.

Figure 3:
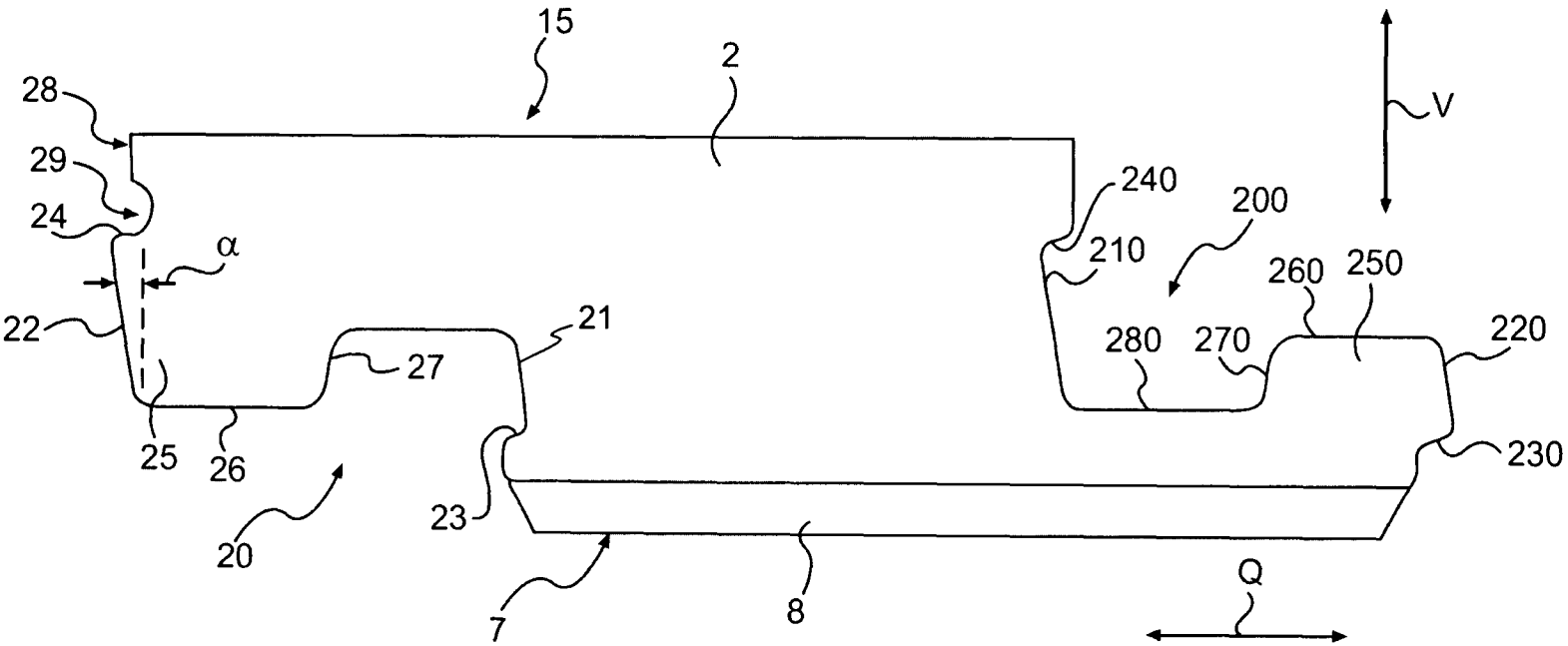
FIG. 3 shows a cross-sectional view of a floor panel with a second side edge.

FIG. 3 shows such a profile on a second side edge in cross section, this preferably being formed on the transverse side of the panel. A step-like milled relief 20 is made in the panel 2, starting from the underside 7, and forms an inner wall 21 and an outer wall 22. Form-fitting elements 23, 24 are formed on, in this case milled out of, the inner wall 21 and the outer wall 22, said elements engaging, in the form of protrusions, in corresponding undercuts 230, 240 of a corresponding recess 200 of a second panel 1. A shoulder 25 is formed in the milled relief 20 and projects in the direction of the underside 7, the outer shoulder wall being formed by the outer wall 22 and the inner shoulder wall 27, in the exemplary embodiment illustrated, forming an upwardly widening cross section. The underside of the shoulder 25 forms a head surface 26 which runs parallel to the top side 15 of the panel 2 and on which the panel 2 is supported, in the installed state, via a corresponding base surface 280 of a corresponding recess 200 of a second panel 1.

As an alternative to the embodiment illustrated, it is provided that the inner surface 27 runs essentially parallel to the outer wall 22, with the result that the inner shoulder wall 27 forms an undercut in relation to the head surface 26. Provision is likewise made for the outer wall 22, in addition to being designed essentially rectilinearly at an acute angle $\alpha$ to the vertical, to be rounded or to run vertically. It is necessary here for the form-fitting element 24 to project beyond the termination edge 28 of the top side 15, in order to carry out form-fitting locking with the second panel.

A recess 29 is formed above the form-fitting element 24 and acts as a dust pocket.

If the inner shoulder wall 27 is designed as an undercut in relation to the head surface 26, additional vertical locking is provided, in particular if the corresponding inner shoulder wall 270 of the upwardly directed shoulder 250 is likewise designed as an undercut. Form-fitting locking then takes place by the profiles being bent up slightly or elastically deformed, with the result that the form-fitting elements 23, 24 and the undercut provided by the inner shoulder wall 27 can pass into effective engagement with the corresponding undercuts 230, 240 and the undercut provided by the inner shoulder wall 270.

The corresponding recess (e.g. other milled relief) 200, which starts from the top side 15, is designed such that it can accommodate the opposite profile, with the result that, on the one hand, the head surface 26 rests in a completely planar manner on the base surface 280 and, on the other hand, the surfaces 15 of the two panels 1, 2 in the installed state, as is illustrated in FIG. 2, terminate in a single plane and are positioned, as far as possible, flush one against the other. The recess 29 above the form-fitting element 24 creates a free space which serves as a dust pocket, and the same applies to the free space, which is formed by corresponding positioning of the inner wall 210 of the corresponding recess (e.g. other milled relief) 200.

As can clearly be seen in FIG. 2, effective locking is provided both in the transverse direction Q and in the vertical direction V, the locking in the transverse direction Q being realized with form-fitting action by the shoulders 25, 250. Locking in the vertical direction V takes place by way of the locking elements 23, 24, which engage with form-fitting action in the undercuts 230, 240, the form-fitting elements 23, 24 being arranged on spaced-apart walls 21, 22.

Furthermore, the form-fitting elements 23, 24 are arranged on different vertical levels, this resulting in the formation of a top locking point and a bottom locking point. The top locking point is formed by the form-fitting element 24 and the undercut 240 formed on inner wall 210, and the bottom locking point is formed by the form-fitting element 23 and the undercut 230 formed on outer wall 220.

The upwardly directed shoulder 250, rather than being formed over the entire length of the second side edge, is milled off down to the base surface 280, this milling being provided in the direction of the first side edge with a tongue 10. By virtue of this milling out or non-formation of the shoulder 250, it is possible, during laying of the panels, for the initially angled panel to be lowered further downward before an abrupt installation movement in the downward direction gives rise to definitive locking via the second side edge, preferably the transverse side.

In the installed state, there is a free space between the head surface 260 of the shoulder 250 and the corresponding surface of the milled relief 20, this free space being necessary in order that the form-fitting element 23 can engage behind the undercut 230. This free space likewise serves as a dust pocket.

It can also clearly be seen in FIG. 2 that a channel 26' is formed in the head surface 26 of the shoulder 25, this channel extending over the entire length of the side edge. The channel 26' serves as a dust pocket and as a material-weakening means, with the result that there is a certain spring effect when the two panels 1, 2 are locked.

What is claimed:

1. A floor panel, comprising:

a top side;

an underside;

a first side edge having a tongue;

an opposite side edge having a recess corresponding to the tongue;

a second side edge extending in a transverse direction to the first side edge and having a first relief comprising an inner wall, a form-fitting element arranged on the inner wall, an inner shoulder wall, an essentially horizontally oriented head surface, an outer wall, and a termination edge arranged on the outer wall; and a side edge opposite the second side edge having a second relief comprising an other outer wall, an undercut corresponding to the form-fitting element arranged on the other outer wall, an other head surface, an other inner shoulder wall, a base surface, an other inner wall, and an other termination edge arranged on the other inner wall, wherein the form-fitting element is structured and arranged to engage the undercut of a substantially identical panel for locking in a vertical direction when the floor panel and the substantially identical panel are connected in an installed state.

2. The floor panel of claim 1, wherein the essentially horizontally oriented head surface is structured and arranged to engage the base surface of the substantially identical panel for locking in the vertical direction when the floor panel and the substantially identical panel are connected.

3. The floor panel of claim 1, wherein the termination edge is structured and arranged to engage the other termination edge of the substantially identical panel for locking in a transverse direction when the floor panel and the substantially identical panel are connected.

4. The floor panel of claim 1, wherein the inner shoulder wall is structured and arranged to engage the other inner shoulder wall of the substantially identical panel for locking in a transverse direction when the floor panel and the substantially identical panel are connected.

5. The floor panel of claim 1, wherein:

the essentially horizontally oriented head surface is structured and arranged to engage the base surface of a substantially identical panel for locking in the vertical direction when the floor panel and the substantially identical panel are connected, the termination edge is structured and arranged to engage the other termination edge of the substantially identical panel to prevent horizontal movement between the floor panel and the substantially identical panel when the floor panel and the substantially identical panel are connected, and the inner shoulder wall is structured and arranged to engage the other inner shoulder wall of the substantially identical panel for locking in the transverse direction when the floor panel and the substantially identical panel are connected.

6. A panel, comprising:

a top side;

an underside;

a first longitudinal side edge having a tongue;

an opposite side edge having a recess corresponding to the tongue;

a second side edge extending in a transverse direction to the first side edge and having a first relief comprising:

an inner wall;

a form-fitting element arranged on the inner wall;

an inner shoulder wall;

an outer wall;

a termination edge arranged on the outer wall;

an essentially horizontally oriented head surface between the outer wall and the inner shoulder wall; and an essentially horizontally oriented surface between the inner shoulder wall and the inner wall; and a side edge opposite the second side edge having a second relief comprising:

an other outer wall;

an undercut, corresponding to the form-fitting element, arranged on the other outer wall;

an other inner shoulder wall;

an other inner wall;

an other termination edge arranged on the other inner wall;

an essentially horizontally oriented base surface between the other inner wall and the other inner shoulder wall; and an other essentially horizontally oriented head surface between the other inner shoulder wall and the other outer wall;

wherein the form-fitting element is structured and arranged to engage the undercut of a substantially identical panel to prevent movement in a vertical direction between the floor panel and the substantially identical panel when the floor panel and the substantially identical panel are connected;

the form-fitting element extends away from the inner wall for a first distance from a proximal end of the form-fitting element at the inner wall to a distal free end of the form-fitting element;

the essentially horizontally oriented surface extends away from the inner wall for a second distance from a proximal end of the essentially horizontally oriented surface at the inner wall to a distal end of the essentially horizontally oriented surface; and the second distance is greater than the first distance.

7. The panel of claim 6, wherein the essentially horizontally oriented head surface is structured and arranged to engage the essentially horizontally oriented base surface of the substantially identical panel to prevent movement in the vertical direction between the floor panel and the substantially identical panel when the floor panel and the substantially identical panel are connected.

8. The panel of claim 6, wherein the termination edge is structured and arranged to engage the other termination edge of the substantially identical panel to prevent movement in a transverse direction between the floor panel and the substantially identical panel when the floor panel and the substantially identical panel are connected.

9. The panel of claim 6, wherein the inner shoulder wall is structured and arranged to engage the other inner shoulder wall of the substantially identical panel to prevent movement in a transverse direction between the floor panel and the substantially identical panel when the floor panel and the substantially identical panel are connected.

10. The panel of claim 6, wherein:

the essentially horizontally oriented head surface is structured and arranged to engage the essentially horizontally oriented base surface of a substantially identical panel to prevent movement in the vertical direction between the floor panel and the substantially identical panel when the floor panel and the substantially identical panel are connected, the termination edge is structured and arranged to engage the other termination edge of the substantially identical panel to prevent movement in a transverse direction between the floor panel and the substantially identical panel when the floor panel and the substantially identical panel are connected, and the inner shoulder wall is structured and arranged to engage the other inner shoulder wall of the substantially identical panel to prevent movement in the transverse direction between the floor panel and the substantially identical panel when the floor panel and the substantially identical panel are connected.

11. The panel of claim 6, wherein the form-fitting element comprises a protrusion formed on the inner wall and extending from the inner wall toward the inner shoulder wall.

12. The panel of claim 6, wherein the essentially horizontally oriented head surface faces downward toward the underside.

13. The panel of claim 6, wherein the essentially horizontally oriented surface faces downward toward the underside.

14. The panel of claim 6, wherein the essentially horizontally oriented base surface faces upward toward the top side.

15. The panel of claim 6, wherein the other essentially horizontally oriented head surface faces upward toward the top side.

16. The panel of claim 6, wherein:

the outer wall is a first transverse distance from a transverse center of the panel;

the distal free end of the form-fitting element is a second transverse distance from the transverse center of the panel; and the first transverse distance is greater than the second transverse distance.

17. The floor panel of claim 1, wherein:

the form-fitting element contacts the undercut of the substantially identical panel when the floor panel and the substantially identical panel are connected in the installed state; and the top side of the floor panel and a top side of the substantially identical panel are positioned in a same plane when the floor panel and the substantially identical panel are connected in the installed state.

18. The floor panel of claim 17, wherein the second side edge of the floor panel includes an essentially horizontally oriented surface between the inner shoulder wall and the inner wall.

19. The floor panel of claim 18, wherein:

the form-fitting element of the floor panel extends away from the inner wall for a first distance from a proximal end of the form-fitting element at the inner wall to a distal free end of the form-fitting element;

the essentially horizontally oriented surface extends away from the inner wall for a second distance from a proximal end of the essentially horizontally oriented surface at the inner wall to a distal end of the essentially horizontally oriented surface; and the second distance is greater than the first distance.

* * * * *